United States Patent [19]

Barker

[11] 3,988,078

[45] Oct. 26, 1976

[54] SEALS FOR ROTARY ENGINES

[75] Inventor: Noble G. Barker, Pekin, Ill.

[73] Assignee: Caterpillar Tractor Co., Peoria, Ill.

[22] Filed: Oct. 23, 1975

[21] Appl. No.: 625,224

[52] U.S. Cl. ..... 418/51; 418/53

[51] Int. Cl.[2] ..... F01C 1/02

[58] Field of Search ..... 418/51, 53, 120–124

[56] References Cited

UNITED STATES PATENTS 3,942,384 3/1976 Parker ..... 418/53

OTHER PUBLICATIONS

Proc. Instn. Mech. Engrs. Publication, vol. 186 62/72 entitled A New Class of Rotary Piston Machine Suitable for Compressors, Pumps and Internal Combustion Engines by J. M. Clarke et al.

*Primary Examiner*—C. J. Husar

*Attorney, Agent, or Firm*—Wegner, Stellman, McCord, Wiles & Wood

[57] ABSTRACT

A rotary mechanism including a housing defining a chamber including an operating cavity, a shaft journalled by the housing, and a rotor within the chamber and journalled on the shaft, the rotor having a plurality of apices on one side thereof. There is a plurality of apex seal-receiving grooves in the rotor, one at each apex, and at least one peripheral seal-receiving groove in a different surface of the rotor and intersecting the apex seal-receiving grooves. The mechanism includes a plurality of elongated apex seals, one at each apex seal-receiving groove, and each apex seal has a first groove in an end thereof in substantial alignment with the peripheral seal-receiving groove and a second groove opening into the corresponding apex seal-receiving groove. Peripheral seals are disposed in the peripheral seal-receiving groove and extended therealong substantially to the first grooves in the apex seal ends. A plurality of first seals is provided, one in each of the first grooves, along with a plurality of second seals, one in each of the second grooves. Thus, the first and second seals substantially seal the intersections of the apex and peripheral seals.

6 Claims, 3 Drawing Figures

SEALS FOR ROTARY ENGINES

BACKGROUND OF THE INVENTION

This invention relates to improved means for sealing the intersection of apex and peripheral seals in rotary mechanisms. Peripheral seals disposed on the rotor of rotary mechanisms and the apex seals employed in such mechanisms generally seal well regardless of the pressure differentials thereacross. However, in the case of piston seals (frequently termed "bolts" or "buttons"), at various stages in the cyclic operation of such mechanisms, there is no ready path for fluid under pressure to be directed to the underside of the piston seal to assist in biasing the same against the wall of the chamber against which it is to seal. Consequently, the opportunity for the existence of an undesirable leakage path at each piston seal at certain points in the operation of such mechanisms exists.

SUMMARY OF THE INVENTION

The principal object of the invention is to provide a new and improved rotary mechanism such as a slant axis rotary mechanism or a trochoidal mechanism, for use as a pump, engine, compressor or the like. More specifically, it is an object of the invention to provide a new and improved sealing means for the intersection of apex and peripheral seals which will establish a good seal at such intersections throughout the operating cycle of such mechanisms and regardless of pressure differentials, to thereby eliminate the undesirable leakage path present in prior art piston seals.

An exemplary embodiment of the invention achieves the foregoing object in a rotary mechanism including a housing defining a chamber including an operating cavity, a shaft journalled in the housing, and a rotor having plural apices within the chamber and journalled on the shaft. Apex seals are carried by the rotor in grooves at each of the apices for sealingly engaging one wall of the chamber. Plural peripheral seals are carried by the periphery of the rotor and intersect the apex seals at the sides thereof and sealingly engage another wall of the chamber. The intersection of the apex seals and the peripheral seals is sealed by first seals carried by at least one end of each of the apex seals and interposed between the adjacent peripheral seals. Second seals are carried by each of the apex seals for sealingly engaging a portion of the groove in which the apex seal is received.

According to a preferred embodiment of the invention, each apex seal has a first groove in an end for receiving the first seal, the groove being in substantial alignment with a peripheral seal-receiving groove. A second groove is provided in each apex seal and opens into the corresponding apex seal-receiving groove and also receives the second seal.

Biasing means are provided for biasing the first and second seals into sealing engagement with the walls that they are to sealingly embrace.

In a highly preferred embodiment of the invention, the rotary mechanism is a slant axis rotary mechanism.

The invention also contemplates that each apex seal has at least two sealing elements for sealingly engaging a wall of the chamber. One of the sealing elements is a wedge member formed of a relatively soft material, while the other of the elements is formed of a relatively hard material. Means are provided for biasing the sealing elements of each apex seal, with the result that the wedge serves to impart a longitudinal bias to the other sealing element of the apex seal to bias that element into sealing engagement with another wall of the chamber.

Other objects and advantages will become apparent from the following specification taken in connection with the accompanying drawings.

DESCRIPTION OF THE PREFERRED EMBODIMENT

Figure 1:
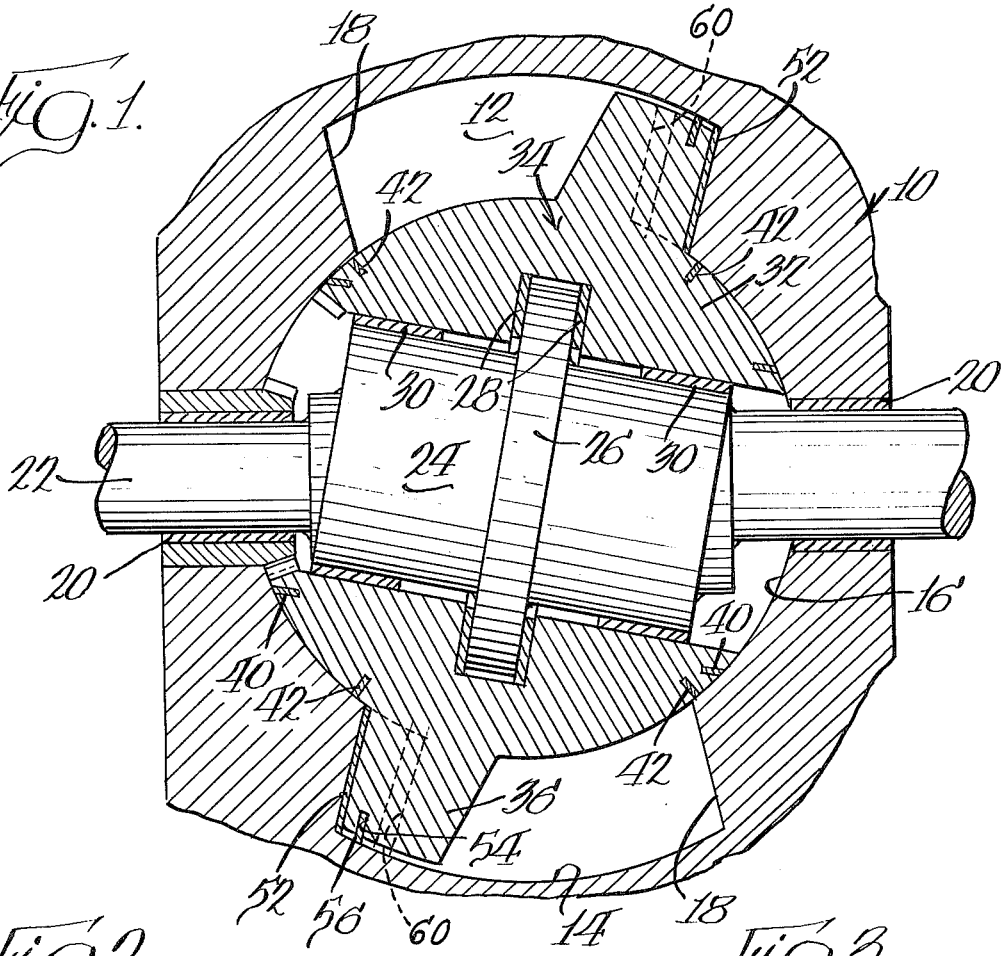
FIG. 1 is a sectional view of a rotary mechanism, specifically, a slant axis rotary mechanism, embodying the invention.

An exemplary embodiment of a rotary mechanism made according to the invention is illustrated in the drawings in the form of a slant axis rotary mechanism, specifically, a four-cycle engine. However, it is to be understood that the principles of the invention find utility in other rotary mechanisms such as trochoidal mechanisms. It is also to be understood that the use of the invention is not limited to engines, but is applicable in pumps, compressors, or the like. Finally, it is to be understood that the principles of the invention are applicable to mechanisms operating on other than four-cycle principles.

The illustrated embodiment of the invention includes a housing, generally designated 10, defining a chamber 12, a part of which serves as an operating cavity as is well known. The chamber 12 is defined by a radially outer spherical wall 14, a radially inner spherical wall 16, and interconnecting, opposed, generally radially extending walls 18. Bearings 20 in the housing journal a shaft 22. The shaft 22 includes an angularly offset eccentric portion 24 disposed within the chamber 12. By means of a thrust collar 26, thrust bearings 28 and journal bearings 30, the hub 32 of a rotor, generally designated 34, is journalled on the angularly offset portion 24.

The rotor 34 includes a peripheral flange 36.

A variety of seals is carried by the rotor. For example, the hub 32, at each end, carries oil seals 40. In addition, at each end of the hub 32 there is provided a compression seal 42.

The flange 36 also carries seals. Specifically, at each apex on the rotor, such as the apex 50 (FIG. 2), a generally radially extending apex seal 52 is provided. The radially outer periphery of the flange 36 is provided with a peripheral seal-receiving groove 54 for receipt of peripheral seals 56.

In a slant axis rotary mechanism, the apex seals 52 sealingly engage one or the other of the side walls 18, while the peripheral seals 56 engage the outer chamber wall 14. In the case of a trochoidal engine (not shown), the apex seals of the rotor would engage the outer peripheral wall while the peripheral seals would engage the side walls.

Figure 2:
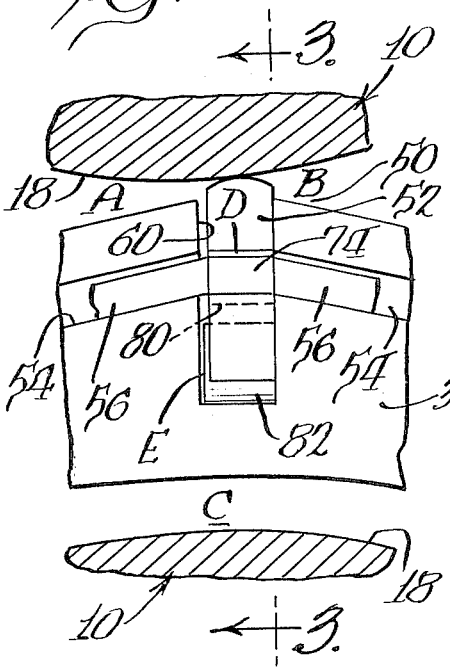
FIG. 2 is an enlarged, fragmentary, developed view of a portion of the mechanism of FIG. 1.
Figure 3:
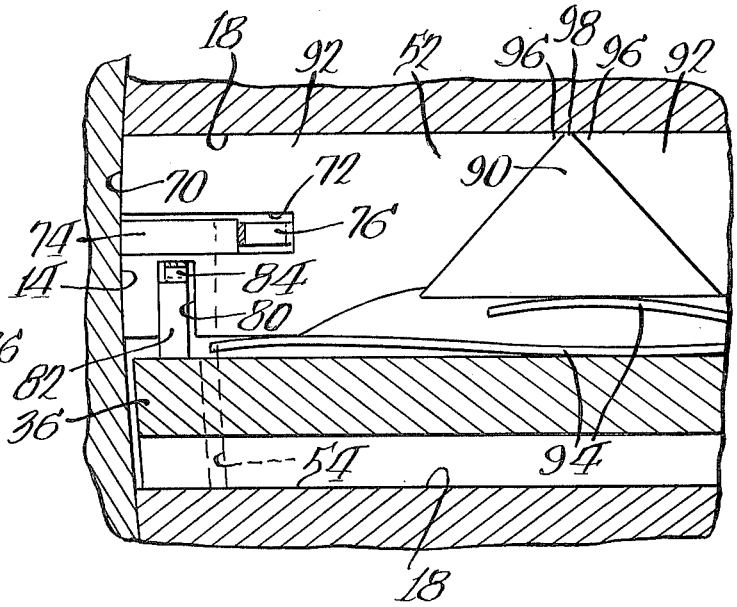
FIG. 3 is an enlarged sectional view taken approximately along the line 3—3 of FIG. 2.

Turning now to FIGS. 2 and 3, it will be seen that each apex seal 52 is received in a groove 60 at each apex 50 on the rotor flange 36.

The groove 60 is slightly wider than the width of the seal 52 to provide for so-called "gas energization" of the seal 52, as is well known.

The grooves 54 for receiving the peripheral seals intersect the groove 60 as illustrated in FIGS. 2 and 3, and receive the peripheral seals 56. Biasing means (not shown) will normally be interposed between the bottom of the grooves 54 and the seals 56 to bias the latter into engagement with the wall 14.

As best seen in FIG. 3, an end 70 of the apex seal 52 is provided with a groove 72 which opens outwardly toward the wall 14, that is, the wall sealingly engaged by the peripheral seals 56. Disposed within the groove 72 is a first sealing element 74 for engagement with the wall 14. A spring 76 is employed to provide a desired bias to this first seal 74.

The seal 74 has a width slightly less than the width of the groove 72 so as to provide for gas energization. And, as seen in FIG. 2, the seal 74 is interposed between the ends of the adjacent peripheral seals 56. It will also be noted that the groove 72 and first seal 74 are so dimensioned that the seal 74 extends inwardly into the apex seal 52 a distance somewhat greater than the depth of the peripheral seal-receiving groove 54.

The end 70 of the apex seal 52 carries a second seal-receiving groove 80 which opens downwardly toward the bottom of the apex seal-receiving groove 60. A second sealing element 82 is disposed in the groove 80 and a spring 84 is located in the groove 80 to bias the seal 82 into sealing engagement with the bottom of the groove 60. The seal 82 has a somewhat lesser width than the width of the groove 80, as illustrated in FIG. 3, for gas energization purposes. As best seen in FIG. 2, it also has a transverse dimension slightly less than the width of the groove 60 so as to ensure that the seal 82 is free to move therein.

In a highly preferred embodiment of the invention, each apex seal 52 is made of two or more elements. FIG. 3 illustrates the apex seal 52 as including a wedge 90 formed of relatively soft material interposed between two elongated sealing elements 92 formed of a relatively hard material. Springs 94 within the groove 60 bias the elements 90 and 92 into sealing engagement with the walls 18. Because of the shape of the wedge 90, part of the bias imparted to the wedge 90 by the spring 94 is converted into a longitudinal biasing force directed against the elements 92 to cause the same to seal against a housing surface at one or more of their ends 70.

The presence of the wedge 90 allows each apex seal 52 to be fabricated to relatively tightly seal at its ends when the mechanism is cold. As the mechanism heats up and the elements 92 expand, they cam the wedge 90 downwardly as points 96 approach each other. While a very small leakage path will be present, it is sufficiently small so as to be tolerable in the interest of achieving thermal compensation in the seal itself.

The wedge 90 is made of a relatively soft material as compared to the material employed for forming the element 92 so as to compensate for wear at the ends of the element 92 as well as at the apex 98 in engagement with the wall 18. Typically, a small flat will develop at the apex 98 after some use, and such development ensures that good sealing will be provided regardless of the wear on the ends of the elements 92.

Excellent sealing at the intersection of the peripheral seals 56 and the apex seals 52 is attained as follows. As illustrated in FIG. 2, there are three sealed chambers, A, B and C, associated with each apex-peripheral seal intersection. When the pressure in sealed chamber A is greater than that in either B or C, only minimal leakage to sealed chamber B will occur through a small gap D existing between the seal 74 and its groove 72.

Very little leakage from chamber A to chamber C will occur. While gas from chamber A will get under the apex seal 52 and bias the same upwardly out of its groove 60, the presence of the sealing element 82 effectively precludes any such gas from leaking into the chamber C.

Where the pressure in chamber B is greater than the pressure in either chamber A or C, leakage is effectively precluded for the reasons set forth above.

When the pressure in chamber C is greater than the pressure in either chamber A or chamber B, the seal 82 will move to the right as viewed in FIG. 3 and seal against the right-hand side of the groove 80 to establish a seal from the chamber C to either chamber A or B via the groove 60. Only a minimal leakage path in a small gap E will be present.

Thus, it will be appreciated that the sealing system of the instant invention provides for gas energization of seals at all times when pressure differentials exist, thereby eliminating detrimental leakage paths present when conventional piston seals or "bolts" are employed.

I claim:

1. In a rotary mechanism including a housing defining a chamber including an operating cavity, a shaft journalled in said housing, a rotor having plural apices within said chamber and journalled on said shaft, apex seals carried by said rotor in grooves at each of said apices for sealingly engaging one wall of said chamber, and plural peripheral seals carried by the periphery of the rotor and intersecting the apex seals at the sides thereof for sealingly engaging another wall of said chamber, the improvement comprising: first seals carried by at least one end of each said apex seal and interposed between the adjacent peripheral seals and sealingly engaging said another wall, and second seals carried by each of said apex seals for sealingly engaging a portion of the corresponding groove.

2. The rotary mechanism of claim 1 wherein said second seals are carried by said one end of the corresponding apex seal.

3. The rotary mechanism of claim 2 including biasing means for biasing said first and second seals into said sealing engagement with said other wall and said groove portion, respectively.

4. The rotary mechanism of claim 1 wherein said shaft has an angularly offset portion within said chamber, said rotor being journalled on said angularly offset portion, said mechanism being a slant axis rotary mechanism.

5. A rotary mechanism comprising:

a housing defining a chamber including an operating cavity, a shaft journalled in said housing, a rotor having plural grooved apices within said chamber and journalled on said shaft, a plurality of apex seals, one for each apex, disposed in said grooves, each said apex seal having at least two sealing elements for sealingly engaging a wall of said chamber, one of said sealing elements being a wedge member formed of relatively soft material and the other of said elements being formed of a relatively hard material, means for biasing said sealing elements into said sealing engagement with said wall whereby said wedge member serves to impart a longitudinal bias to said other sealing element to bias said other sealing element into sealing engagement with another wall of said chamber, peripheral seals carried by said rotor on a peripheral surface thereof and intersecting said apex seals, and additional sealing means disposed at the intersection of said apex seals and said peripheral seals, including first seals carried by at least one end of each said apex seal and interposed between the adjacent peripheral seals and sealingly engaging said another wall, and second seals carried by each of said apex seals for sealingly engaging a portion of the corresponding groove.

6. A rotary mechanism comprising:

a housing defining a chamber including an operating cavity;

a shaft journalled by said housing;

a rotor within said chamber and journalled by said shaft, said rotor having plural apices on one surface thereof;

a plurality of apex seal-receiving grooves in said rotor one surface, one at each apex;

at least one peripheral seal-receiving groove in another surface of said rotor and intersecting said apex seal-receiving grooves;

a plurality of elongated apex seals, one in each said apex seal-receiving groove, each said apex seal having a first groove in an end thereof in substantial alignment with said peripheral seal-receiving groove and a second groove opening into the corresponding apex seal-receiving groove;

peripheral seals disposed in said peripheral seal-receiving groove and extending therealong substantially to said first grooves;

a plurality of first seals, one in each of said first grooves; and a plurality of second seals, one in each of said second grooves;

whereby said first and second seals substantially seal the intersections of said apex and peripheral seals.

* * * * *